United States Patent [19]

Corbellini

[11] Patent Number: 4,895,623

[45] Date of Patent: Jan. 23, 1990

[54] METHOD TO DE-WATER PULP FOR PAPER USING A SIPHON WITH SIMULTANEOUS FORMATION OF SHEET IN A TWO-WIRE SYSTEM, AND APPARATUS WHICH EMPLOYS SUCH METHOD

[75] Inventor: Glauco Corbellini, Udine, Italy

[73] Assignee: A.W.E. Anti Wear Engineering Srl, Udine, Italy

[21] Appl. No.: 90,769

[22] Filed: Aug. 26, 1987

[30] Foreign Application Priority Data

Sep. 5, 1986 [IT] Italy ..... 83401 A/86

[51] Int. Cl.[4] ..... D21F 11/00; D21F 1/48

[52] U.S. Cl. ..... 162/203; 162/217; 162/301; 162/303; 162/364

[58] Field of Search ..... 162/203, 205, 211, 217, 162/300, 301, 303, 348, 352, 363, 364, 374

[56] References Cited

U.S. PATENT DOCUMENTS

| | | | |
|---|---|---|---|
| 2,881,675 | 4/1959 | Thomas | 162/301 |
| 2,881,676 | 4/1959 | Thomas | 162/301 |
| 2,893,486 | 7/1959 | Marti | 162/357 |
| 3,438,854 | 4/1969 | Means | 162/203 |
| 3,595,744 | 7/1971 | Skoldkvist | 162/301 |
| 3,823,062 | 7/1974 | Ward et al. | 162/301 |
| 3,997,390 | 12/1976 | Kankaanpaa | 162/303 |

FOREIGN PATENT DOCUMENTS 1247013 9/1971 United Kingdom .

OTHER PUBLICATIONS

Random House Dictionary of the English Language, p. 1332, 1967.

*Primary Examiner*—Karen Hastings
*Attorney, Agent, or Firm*—Wegner & Bretschneider

[57] ABSTRACT

A method to simultaneously de-water and form a sheet of pulp is disclosed. The method employs a pair of wire meshes, the meshes being adapted to move continuously under tension and to receive pulp continuously from a stock inflow tank. A layer of pulp is subjected simultaneously to progressive mechanical compression and to aspiration of the water at a constant value owing to a siphon effect. Also disclosed is an apparatus to carry out this method.

9 Claims, 3 Drawing Sheets

METHOD TO DE-WATER PULP FOR PAPER USING A SIPHON WITH SIMULTANEOUS FORMATION OF SHEET IN A TWO-WIRE SYSTEM, AND APPARATUS WHICH EMPLOYS SUCH METHOD

This invention concerns a method to dewater pulp for paper with simultaneous formation of sheet in a two-wire system.

The invention provides also a plant to dewater pulp for paper with simultaneous formation of sheet in a two-wire system which employs such method.

The devices too which carry out such method form part of the invention.

The invention can be applied in the case of upward formation of paper, or downward formation of paper, or a combined formation.

Drainage systems in machines manufacturing paper are known. In such machines the pulp employed to make the paper comprises initially a very high percentage of water in relation to the quantity of fibres, fillers and loading which form the final paper.

In the case of horizontal machines such pulp is deposited continuously on the upper surface of a mesh, called a "wire", which runs continuously and is kept under tension between two reciprocally distant rolls which drive the wire.

In an operation of downward drainage of the water the wire forms a filter, on which the fibres are deposited and constitute a layer, while the water passes through the wire downwards.

The best systems have already been applied to the pulp to make it as homogeneous as possible, and efforts are now being made to obtain the best results as regards homogeneity by performing as perfect a drainage as possible during formation of the paper.

With a horizontal wire the pulp deposited on the wire has its lower surface meniscus between the links of the mesh of the wire. This situation forms a hindrance to drainage below certain values of water content, such values however being very high.

Such meniscus can be perforated naturally only by means of independent droplets formed on the surface below the wire.

The drainage droplets create movements of water at various points by concentrating and directing the fibres towards such points, so that an irregular formation is produced with so-called "rice grain" flocculations.

The wire supports, the upper surfaces of which cooperate with the lower side of the wire, are employed to increase and improve the natural drainage.

These supports, such as the table rolls, baffle plates and drainage foils, however, are able to eliminate such formation defects only partially.

The formation begins to take place immediately downstream of the stock inflow tank and is hard to alter thereafter even by using auxiliary pneumatic means such as the suction boxes and other known equipment.

Thus it is only by preventing the irregular formation of flocculations at the very beginning that it is possible to make properly finished paper, and this is a thing that so far no one has been able to accomplish.

Next, the fact that with a horizontal wire the drainage takes place downwards leads to the production of two different surfaces on the paper, the lower surface in contact with the wire being the better of the two.

Various systems have been invented to make paper with identical surfaces. Such systems normally provide for the application of a second wire above the normal wire, thus compressing the pulp between the two wires. Such wires may even be positioned vertically.

Whether the wires are horizontal or vertical, the drainage entails several problems and the results obtained in performing the drainage with the known systems have still not attained the levels expected.

The present applicant has therefore studied and realized a method to dewater pulp for paper with simultaneous formation of the sheet in a two-wire system that enables the expected results of a uniform formation to be obtained without even small areas of irregular flocculation.

So as to realize the method, the present applicant has embodied suitable, new devices, which he has applied to a plant to dewater pulp for paper with simultaneous formation of the sheet in a two-wire system.

According to the invention the method provides for the formation of sheet and the drainage action to take place at the same time, thus preventing the formation of even partial, uncontrolled, irregular flocculations in the pulp leaving the stock inflow tank.

Such method of drainage provides for a suction mouth of a hydraulic siphon which enables the formation and the drainage to take place at one and the same time with a uniform depositing of the fibres.

The drainage action according to the invention takes place with constant values and is characterized by a slow speed of movement of the water thus drained.

Moreover, the energy required to perform the operation in the proposed method is supplied free of charge by the force of gravity.

Owing to the method the force of gravity has the effect that, if so required, the fibres are placed from below upwards, thus improving the upper surface of the paper in systems with horizontal wires.

The invention can be applied to the formation of paper with an upwards system, or downwards system, or a combined system.

Furthermore, the proposed method enables the meniscus to be eliminated from the neighbourhood of the wire.

The invention is therefore obtained with a method to dewater pulp for paper with simultaneous formation of sheet in a two-wire system, which can be applied to vertical or horizontal wires, the wires being able to move continuously under tension and to receive pulp continuously from a stock inflow tank, the method being characterized in that a layer of pulp moving lengthwise is subjected at once to an action of progressive mechanical compression of a desired algorithm and to an action of aspiration of the water, and only of the water, at a constant value owing to a siphon effect.

The invention is also embodied with devices suitable to carry out such method and with plant employing such method.

The attached figures, which are given as a non-restrictive example, show the following:

Figure 1:
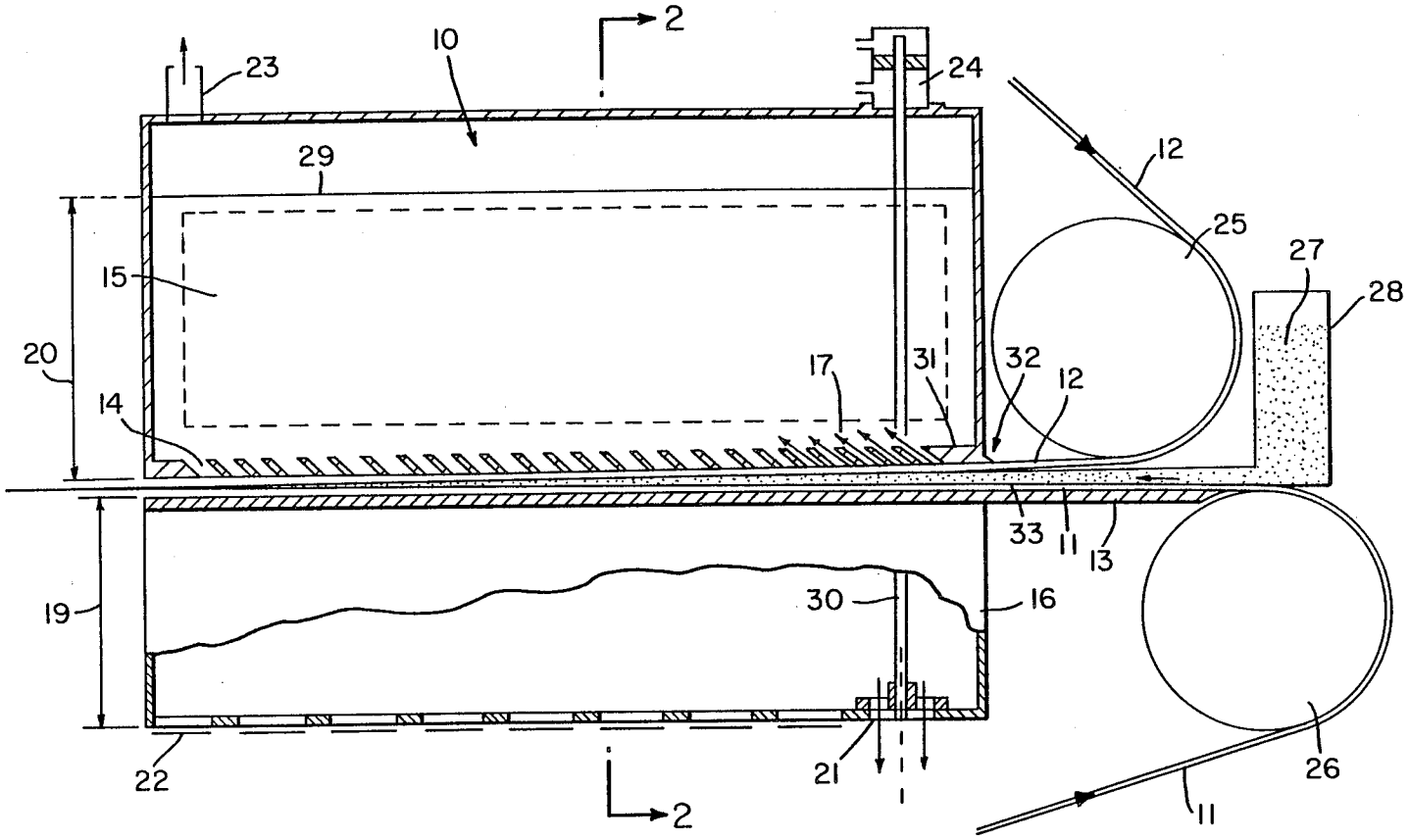
FIG. 1 shows a side view of the invention as applied to a paper manufacturing machine with horizontal wires and with one single aspiration system suitable for upward formation of the paper.

In the figures a lower wire 11 and upper wire 12 cooperate with a lower support 13, upper siphon mouth 14 and a stock inflow tank 28 for pulp 27.

The lower wire 11 conveys the pulp 27 leaving the stock infow tank 28 and slides on the lower support 13.

The pulp 27 deposited on the lower wire 11 is compressed in its movement towards the siphon mouth 14 by the tapered conformation of an inflow passage 31 formed between the lower wire 11 and upper wire 12.

Such tapered inflow passage 31 can be varied to suit the conformation of an inlet edge 32, siphon mouth 14 and position of an upper breast roll 25.

In FIG. 1 the upper meniscus of the pulp 27 in the zone of formation of the paper disappears since the pulp 27 is submerged together with the upper wire 12 by the quantity of the water contained.

Such effect of the elimination of the meniscus in the neighbourhood of the upper wire 12 is typical of the method, which arranges to keep the upper side of the upper wire 12 covered with a layer of water and to keep the upper wire 12 itself immersed in that water.

Such layer of water, the level of which is referenced with 29, is obtained by a device 10 by controlling the discharge of water.

At start-up the layer of water may be created artificially and be maintained automatically during working.

According to the invention the level 29 positioned above the respective wire, namely the upper wire 12 in the examples of FIGS. 1 and 2, with a working head 20 and with discharge outlets 21–22 located below the respective wire 12 in the examples of FIGS. 1 and 2 enables a constant negative pressure to be maintained in the siphon box 14 and therefore an action of uniform aspiration to be applied to the upper wire 12.

Figure 2:
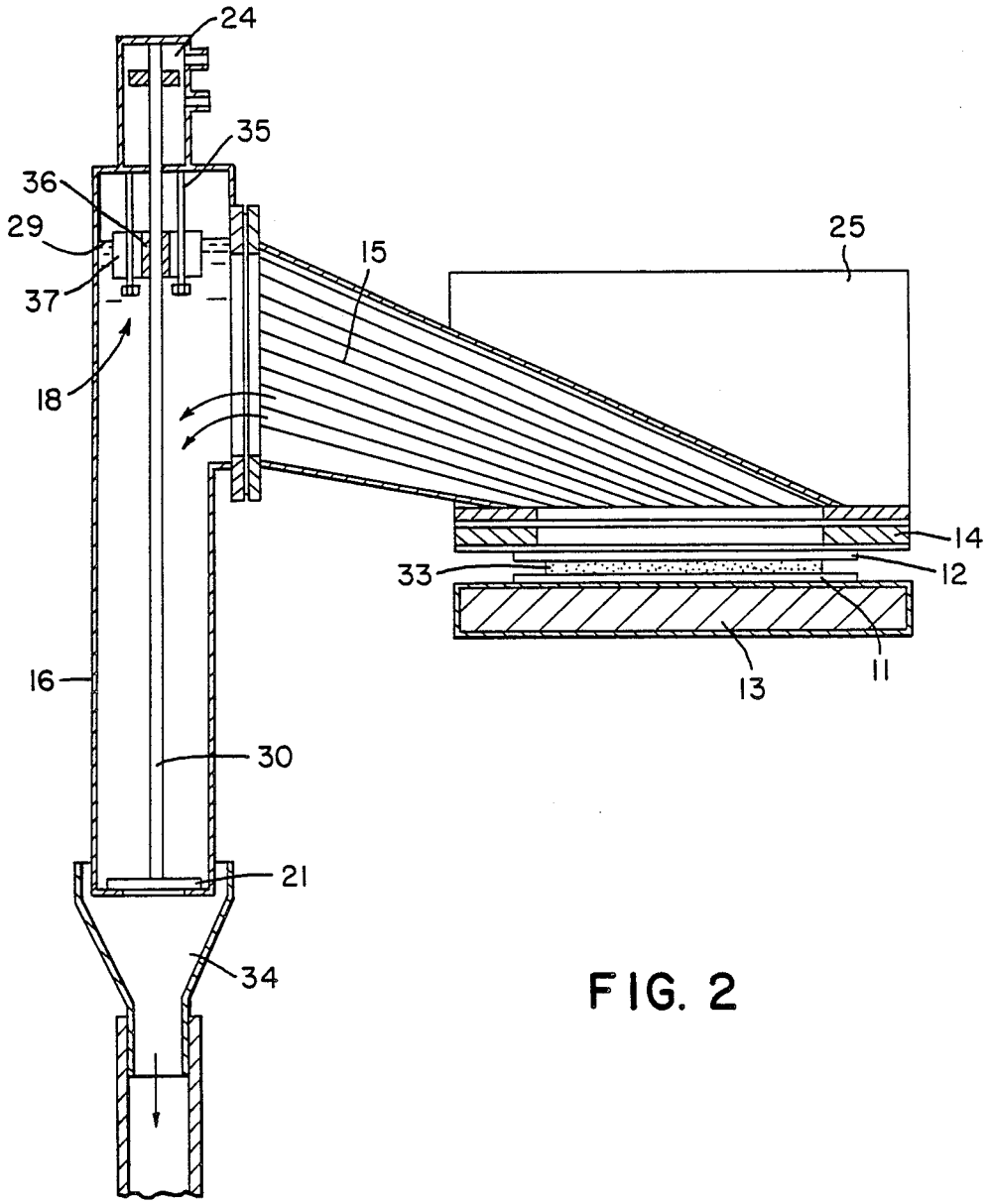
FIG. 2 shows a cross section of the embodiment of FIG. 1, viewed along lines 2—2.

FIG. 2 shows a device 10 able to produce such situation. In the figure it is possible to see above the upper wire 12 a siphon box 14 which communicates with a manifold 15 into which the water flows according to the arrows 17 during working.

The manifold 15 delivers the water to a drainage tank 16, which comprises at its bottom a series of progressive closures, such as progressive closures 22 shown in FIG. 1, of a fully open or fully closed type and also one or more automatic valves 21 that serve to regulate constantly and to maintain the level 29.

A conical collection chamber 34 cooperates with the lower portion of the drainage tank 16.

In the example shown the valve 21 is controlled by two systems; a means 24, a jack for instance, serves to provide a remote control by means of a rod 30; another means 18 serves, also by means of the rod 30, to control the valve 21 automatically by using the level 29. In the example shown this second means 18 provides for a float 37 able to slide vertically along guide rods 35.

In this second example the float 37 cooperates with a screw 36 having a coarse pitch and providing a rapid ascent or descent, so that if the level 29 is raised, such level raises the float 37, which in turn actuates the valve 21, thus causing discharge of water and lowering the level 29.

Drainage water is removed from the layer of pulp 33 by the effect of negative pressure 19 derived from the natural continuous siphon fed by the water in the pulp, the siphon exploiting the energy of the force of gravity in its functioning.

Negative pressure having a value equal to working head 20 is applied to an outlet pipe 23 by suction device 44 ensures that the siphon will function during start-up of the machine, and eliminates continuously any harmful air contained in the water for various reasons.

The inside of the manifold 15 consists of suitable channels that serve to control and ensure a uniform flow of water 17 through the siphon mouth 14.

The conformation of the manifold 15 cooperates with the constant negative pressure produced on the upper wire 12 owing to the constant negative working pressure caused by the head 19.

According to the invention the manifold 15 is conformed advantageously so as to diverge in the direction of feed of the water and has a minimum section of flow, or passage, which is a multiple of, and therefore considerable in relation to, that of the outlet of the stock inflow tank 28 for the pulp 27.

Therefore, the speed of the water inside the manifold 15 is extremely slow compared to the speed of the pulp leaving the outlet of the stock inflow tank 28 and thus to the speed of formation of the layer 33 of pulp.

This makes it possible to obtain, between the two wires 11–12 below the siphon mouth 14, an overpressure that assists drainage through the accumulation of fibres on the upper wire 12 while such wire is moving forwards towards the downstream end of the siphon mouth 14.

While the upper wire 12 continues its foward movement, the mechanical pressure on the layer of pulp 33 increases gradually owing to the desired conformation of the distance between the siphon mouth 14 and the lower support 13, the accumulation of fibres thickening at the same time.

The mechanical pressure together with the negative pressure of a constant value ensures the required drainage, which can be varied by acting on the value of the negative pressure or on the geometry of the contact face of the drainage tank or on both such factors.

The conformation of the lower face of the siphon mouth 14 in contact with the upper wire 12 is shaped lengthwise in the manner of a tensioned catenary and enables the free lengthwise section of the space between the upper and lower wires 11–12 to be reduced according to a required algorithm; if this algorithm is varied, the gradient of mechanical pressure is also varied.

We have used the words "tensioned catenary" to indicate a curve which in practice, depending on a desired algorithm, may belong to the class of catenaries or to a class of different curves; thus hereinafter with the words "tensioned catenary" is meant the whole plurality of possible curves.

In the figure the lower support 13 is substantially flat; it may be completely solid or may comprise a controlled and oriented perforation. Such controlled perforation will permit a desired, downward drainage, which can be increased to considerable values by enlarging the perforation.

In a variant, instead of the lower support 13, a duplicate 110 of the dewatering device 10 may be provided to cooperate with the lower wire 11.

In such variant the upper face of the lower dewatering device 110 is provided by a lower siphon mouth 114 and will comprise an outer, lower support segment 13 that extends to the neighbourhood of a breast roll 26 of the lower wire 11.

Moreover, such upper face supporting the lower wire 11 may be conformed either straight or with a tensioned catenary in the lengthwise direction.

The lengthwise conformation of the upper face of the lower siphon mouth 114 cooperates with the lengthwise conformation of the lower face of the upper siphon mouth 14 in fulfilling the desired law of lengthwise reduction of the free section between the two wires 11–12.

Figure 3:
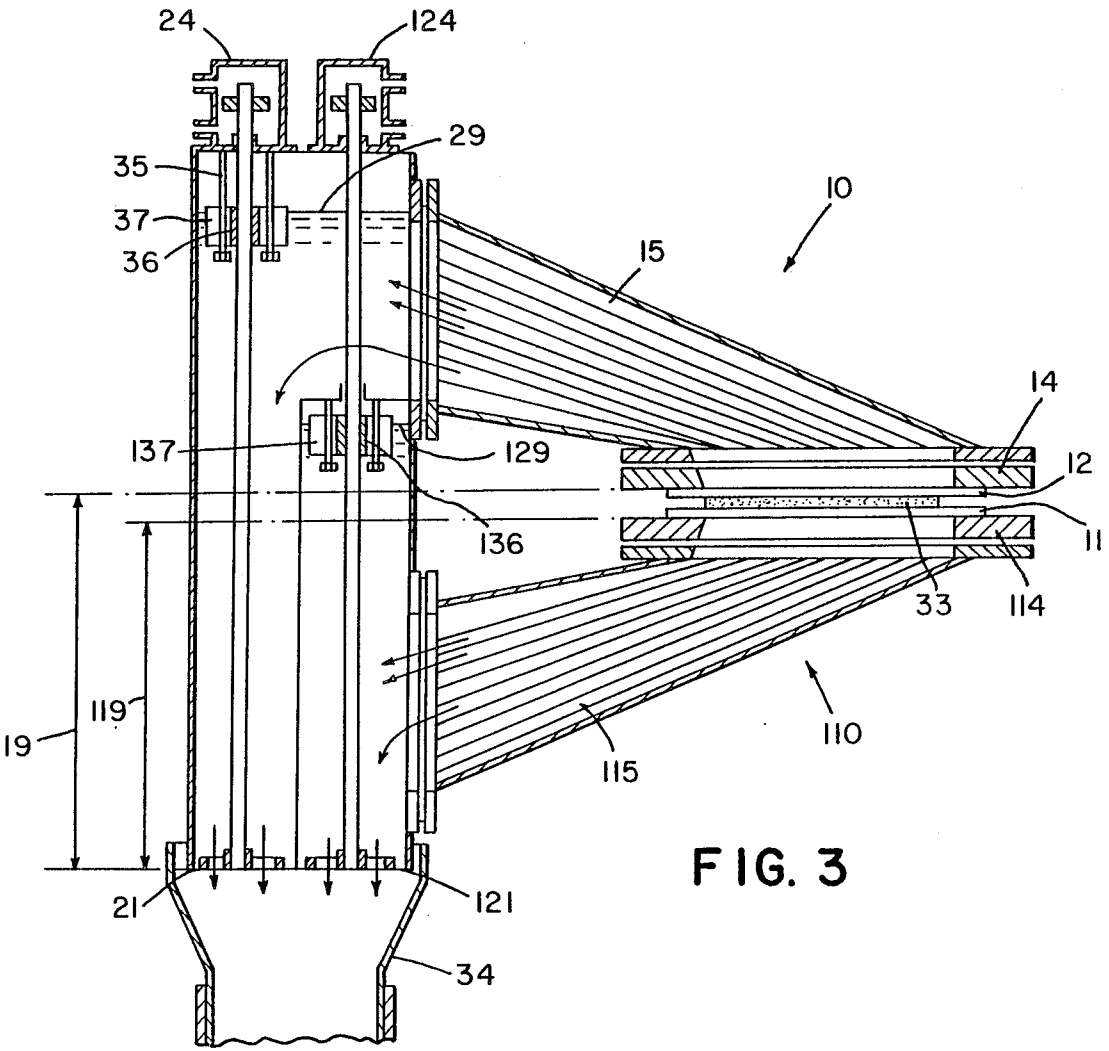
FIG. 3 shows a cross section of a variant with a double drainage system for combined formation of paper, both upwards and downwards.

FIG. 3 shows the lower dewatering device 110, which is substantially the same as the upper device 10; the same reference numbers are used but are increased by 100 to prevent confusion.

The lower head 119 of pressure may be the same as or slightly less than the upper head 19.

In the variant of FIG. 3 the purpose of controlling the downward flow is attained with a perfect symmetry of deposition of fibres, paper with two identical faces being obtained.

In another variant a device 110 cooperates with an upper support, such as upper support 13 shown in FIG. 1 which replaces the upper device 10 and may extend to an upper breast roll 25.

This variant covers the formation of paper from below, whereas the examples in FIGS. 1 and 2 show the formation of paper from above and FIG. 3 shows the combined formation of paper from above and from below.

The above variants with appropriate variants of design can also be employed with vertical wires 11–12 provided that the formation of the paper is always obtained under a head of water with the two wires completely immersed on their four faces.

In a further variant the discharge tanks may have automatic valves 21 at different levels, and the head of negative pressure 19 may be varied according to the automatic valve 21 actuated (when the other valves at other levels remain closed).

Likewise, the level of water 29 can be varied as required to obtain the required working head 20.

I claim:

1. A method to simultaneously form and siphon water from a sheet of pulp comprising:

providing upper and lower continuously moving wire meshes, said meshes being spaced apart to define an area for receiving the pulp, supplying said pulp between said meshes, and simultaneously progressively mechanically compressing the pulp a predetermined amount and siphoning water, and essentially only water, from the pulp, using a siphon having a siphon mouth in contact with an upper surface of the upper wire mesh, wherein an upper end of the siphon is kept in contact with the atmosphere via a negative pressure source which raises water in the siphon to a predetermined height above the meshes conducting the siphoning of water at a constant value by preventing a meniscus from forming on said meshes, wherein said meshes are located at a level and extend essentially horizontally, and the meniscus is prevented from forming by the siphoning of water to a level above the level of said meshes, and wherein said negative pressure source keeps the siphon full of water for a start-up of the siphon.

2. The method of claim 1, wherein said siphon mouth has a contact face which contacts the upper mesh, wherein said upper mesh is in a condition of tension due to sliding contact with the contact face of said siphon mouth.

3. The method of claim 2, wherein the velocity of the pulp supplied between the meshes is greater than the velocity of the water siphoned from said pulp.

4. The method of claim 1, wherein the level of water above the level of said meshes is kept substantially constant.

5. An apparatus to simultaneously form and siphon water from a sheet of pulp comprising:

upper and lower wire meshes, said meshes moving continuously under tension and receiving pulp between the meshes, wherein said meshes are immersed in said siphoned water, a stock inflow tank for continuously supplying pulp to said meshes, and a siphon mouth for siphoning water, and essentially only water, from said pulp and for supporting at least one of said meshes, said siphon mouth having a contact face which contacts said upper mesh so that said upper mesh conforms to said contact face, a drainage tank for draining said siphoned water from said apparatus, a manifold for transporting said siphoned water from said siphon mouth to said drainage tank, a negative pressure source, located in an upper end of the drainage tank and connected to the atmosphere, which raises water in the drainage tank to a predetermined height above the meshes, and wherein said drainage tank is located adjacent said meshes so that a portion of the drainage tank extends above the meshes and a portion of the drainage tank extends below the meshes, the manifold extends upwards from said siphon mouth to said drainage tank.

6. The apparatus of claim 5, further comprising valve means located in said drainage tank for maintaining a constant siphoning head for siphoning said siphoned water from pulp.

7. The apparatus as claimed in claim 6, wherein said valve means comprises at least one valve located in a lower portion of the drainage tank, a float disposed in the drainage tank, and a rod connecting the float to the at least one valve.

8. The apparatus of claim 5, wherein said meshes approach each other so as to progressively mechanically compress the pulp a predetermined amount.

9. An apparatus to simultaneously form and siphon water from a sheet of pulp comprising:

a pair of wire meshes, said meshes moving continuously under tension and receiving pulp between the meshes, wherein said meshes are immersed in said siphoned water, a stock inflow tank for continuously supplying pulp to said meshes, a siphon mouth for siphoning water, and essentially only water, from said pulp and for supporting at least one of said meshes, said siphon mouth having a contact face which contacts said at least one of the meshes and which assumes a tensioned catenary conformation, a drainage tank for draining said siphoned water from said apparatus, a manifold for transporting said siphoned water from said siphon mouth to said drainage tank, and valve means located in said drainage tank for maintaining a constant siphoning head for siphoning said siphoned water from pulp, said valve means comprising at least one valve located in a lower portion of the drainage tank, a float disposed in the drainage tank, and a rod connecting the float to the at least one valve.

* * * * *